US007866192B2

(12) United States Patent
Gianelo

(10) Patent No.: US 7,866,192 B2
(45) Date of Patent: Jan. 11, 2011

(54) LOCKING MECHANISM FOR USE WITH A DRAWER

(76) Inventor: Angelo Gianelo, P.O. Box 359, Salt Lake City, UT (US) 84110

( * ) Notice: Subject to any disclaimer, the term of this patent is extended or adjusted under 35 U.S.C. 154(b) by 343 days.

(21) Appl. No.: 12/074,883

(22) Filed: Mar. 7, 2008

(65) Prior Publication Data

US 2009/0013732 A1 Jan. 15, 2009

Related U.S. Application Data

(60) Provisional application No. 60/905,407, filed on Mar. 7, 2007.

(51) Int. Cl.
*E05B 65/46* (2006.01)

(52) U.S. Cl. ..... 70/85; 70/82; 70/71; 312/333

(58) Field of Classification Search ..... 70/71, 70/82–86, 110; 312/333
See application file for complete search history.

(56) References Cited

U.S. PATENT DOCUMENTS

| | | | | | |
|---|---|---|---|---|---|
| 588,237 | A * | 8/1897 | Parker | 70/71 |
| 1,390,403 | A * | 9/1921 | Voight | 70/82 |
| 1,444,820 | A * | 2/1923 | Wilkinson | 70/82 |
| 1,485,388 | A * | 3/1924 | Goldsmith et al. | 70/1.5 |
| 1,646,674 | A * | 10/1927 | Fedele | 70/109 |
| 2,172,169 | A * | 9/1939 | Arthur | 70/82 |
| 2,271,431 | A * | 1/1942 | Leo et al. | 312/333 |
| 2,793,927 | A * | 5/1957 | Reitzel | 312/219 |
| 3,158,016 | A * | 11/1964 | Fay | 70/82 |
| 3,457,744 | A * | 7/1969 | Bisbing | 70/82 |
| 3,789,633 | A * | 2/1974 | Crepinsek | 70/110 |
| 3,834,780 | A * | 9/1974 | McClellan et al. | 312/219 |
| 3,975,934 | A * | 8/1976 | Babai et al. | 70/120 |
| 4,547,006 | A * | 10/1985 | Castanier | 292/37 |
| 4,741,186 | A * | 5/1988 | Martin | 70/100 |
| 6,354,121 | B1 * | 3/2002 | Frolov | 70/277 |
| 7,155,946 | B2 * | 1/2007 | Lee et al. | 70/107 |

* cited by examiner

*Primary Examiner*—Suzanne D Barrett
(74) *Attorney, Agent, or Firm*—TraskBritt

(57) ABSTRACT

A locking mechanism for use in drawers of cabinet structures including a pair of bolts secured for lateral displacement along the interior face of the drawer front. A latch having a flange is rotationally secured to the drawer to permit the flange of the latch to be positioned between the opposing ends of the bolts and thereby preclude their further displacement. A lever, rotationally mounted out of the path of travel of the bolts is associated with an externally mounted lock that permits the user to rotate the lever and lift the latch flange out of engagement with the bolts, thereby permitting the bolts to be displaced out of a locking engagement with the cabinet structure.

17 Claims, 3 Drawing Sheets

LOCKING MECHANISM FOR USE WITH A DRAWER

CROSS-REFERENCE TO RELATED APPLICATION

This application claims the benefit under 35 U.S.C. 119(e) of U.S. Provisional Patent Application Ser. No. 60/905,407, filed Mar. 7, 2007.

TECHNICAL FIELD

This invention is directed to a mechanism for use in controlling the access to a drawer structure. More specifically, the invention is directed to a mechanism that may be used to lock a drawer.

BACKGROUND

Storage cabinets, fitted with a plurality of drawers, are well known in the art. Such cabinets typically include a frame structure having a number of upstanding walls that extend upwardly from a base or floor. A top is conventionally secured to the upper edges of the upstanding walls to form a substantially box-like structure having an open side in association with a plurality of closed side panels. In a conventional construction, the interior of this box-like structure is fitted with a plurality of ledges or guides that are configured and otherwise positioned to guide one or more laterally displaceable drawers. Each drawer is formed from a laterally extending floor panel and a plurality of upstanding side panels secured proximate the edges of the floor panel.

In a traditional configuration, each drawer includes two parallel side panels and a back panel that is positioned substantially orthogonally to the two side panels. The side and back panels are secured to one another at their upstanding edges to form a generally "U"-shaped structure when viewed from above. A front panel extends between the forward-most vertical edges of the two side panels. The front panel may include a planar face panel and a corresponding planar back face. The planes of the face panel and the back face are typically positioned in a parallel arrangement.

In common constructions, the face panel of the drawer may be fitted with a handle that may be grasped by a user for purposes of applying a horizontally directed force to the drawer and thereby effect a lateral displacement of the drawer outwardly from within the interior of the cabinet interior. The handle may also be used to apply an oppositely directed horizontally directed force to the drawer to return the drawer to its previous location within the cabinet structure.

Many conventional drawer configurations have also included some type of locking mechanism that could be employed by the user to secure the drawer against unauthorized access by third parties.

Cabinets that are utilized in industrial environments are oftentimes subjected to dirt and other contaminants that may foul or otherwise adversely affect the operation of drawer locking mechanisms. There continues to be a need for a drawer locking mechanism that is simple in construction and effectual in precluding the unauthorized access to a drawer by third parties.

SUMMARY OF THE INVENTION

A drawer locking mechanism of the instant invention is adapted for use with a drawer disposed within a cabinet. The mechanism may be configured for physical securement to the interior face of the frontpiece or face panel of a drawer. The mechanism includes a first bolt that is displaceably secured to the drawer. The first bolt has a free end adapted for engagement with the structure of the cabinet for forming a securing locked association with the cabinet. A latch is constructed for pivoted securement to the drawer, preferably to the interior face of the face panel of the drawer. The latch is positionable into a location in abutment against the first bolt to thereby retain the first bolt in a locked condition and preclude a lateral displacement of the bolt in a given direction. The latch includes an extension element. In the installed condition of the latch, the extension is spacedly disposed from a path of travel of the first bolt. The mechanism further includes a displaceable lever, constructed for disposition within the drawer. The lever is positioned to engage the extension of the latch and thereafter displace the extension, thereby moving the latch out of engagement with the first bolt and thereby permitting the first bolt to be displaced into an unlocked condition.

In a preferred construction, a biasing mechanism may be secured to the first bolt for biasing the first bolt into a closed condition. In one construction, this biasing mechanism may be secured to an end of the first bolt.

In yet another embodiment of the invention, a second displaceable bolt may be secured to the interior face of the drawer face panel. The second bolt may include a free end configured to engage and otherwise interact with the structure of the cabinet to form a detachable locking engagement. The second bolt may be mounted for travel along a pathway having an axis that is co-linear with the axis of a pathway of travel for the first bolt, albeit that the directions of travel of the two bolts may be 180 degrees removed from one another. In one embodiment, the latch is disposed intermediate the two bolts such that in a locked condition, the latch precludes the displacement of the two bolts toward one another along their common axis of travel.

In a further embodiment, the lever is positioned spacedly from the travel path of the first bolt and preferably the travel path of the second bolt. The lever may include an extension member that is displaceable to engage the extension element of the latch and thereby displace the extension as well as the latch itself out of engagement with one or both of the bolts. The lever may be adapted to be actuated from an exterior surface of the drawer face panel. In one embodiment of a preferred construction, the axis of rotation of the lever is oriented perpendicular to the directions of travel of the two bolts.

DETAILED DESCRIPTION OF THE DRAWINGS

Figure 1:
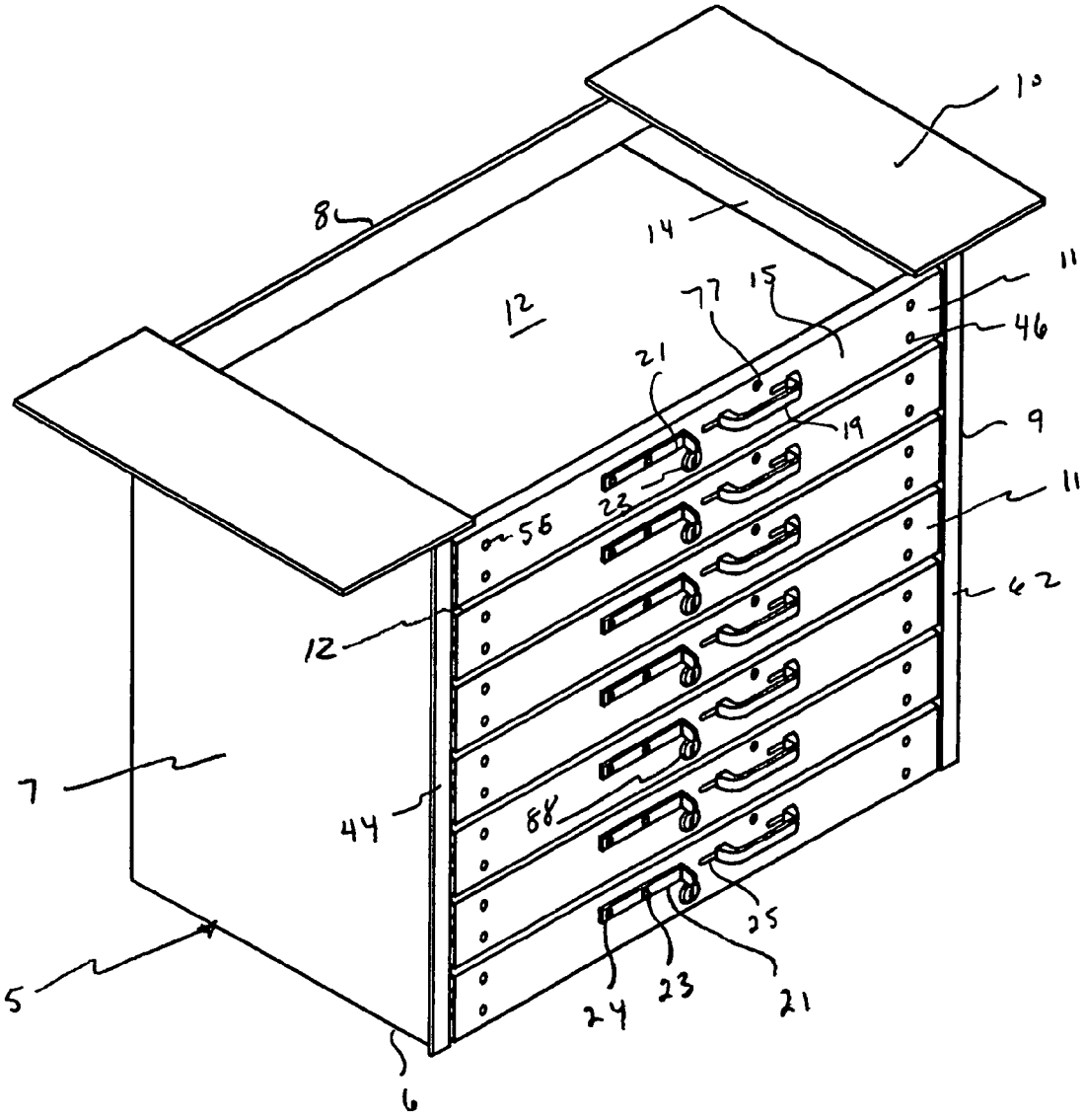
FIG. 1 is a perspective view of a cabinet having a plurality of drawers positioned therein.

As shown to advantage in FIG. 1, a cabinet 5 includes a base member 6 having a generally rectangular configuration from which two side panels 6 and 9 extend vertically upwards. Each of the side panels 7 and 9 is formed of a planar rectangle configured panel that is joined to the base member 6 along the edge of that base member to extend upwardly perpendicularly from the base member 6. A back panel 8 is also secured to the base member 6 along its longitudinal edge to extend upwardly essentially perpendicularly from the base member 8. The top of the cabinet 5 is formed by a series of panels 10. Fitted into the rectangular configured box-like structure of the cabinet 5 is a series of drawers 11.

Each of the drawers is disposed within a respective compartment defined by a divider 12 that vertically separates each drawer from its adjacent drawer. The hollow compartment that retains each drawer may also be fitted with guides and conventional structures typically associated with cabinet drawer openings. Each drawer 11 includes a front panel 15, which forms and otherwise defines the face of the drawer. As further shown in FIG. 1, each drawer 11 includes a first handle 19, which is shown as a generally elongated "U"-shaped element with the ends of each of its legs being each individually received within a respective horizontally extending slot defined within the surface of the front panel 15 of the drawer. As will be explained subsequently, the elongated slots permit a displacement of the handle 19 in a lateral direction, both toward the left as well as toward the right of the cabinet.

A second handle 21 is also shown being associated with each drawer 11. This second handle is illustrated as a generally "L"-shaped member with the long leg of the "L" member being positioned parallel to the surface of the front panel of the drawer while the shorter leg of the "L" is shown extending outwardly from the front panel of the drawer. Although not shown in FIG. 1, each handle 21 is also associated with a pair of elongate slots 37 and 39 (shown in phantom representation in FIG. 2) that extend laterally along the surface of the front panel 15. A pair of pins, identified as pins 23 and 24, extend through the body of the handle 21 subsequently through slots 37 and 39. The ends 71 and 72 of these pins 23 and 24 are shown secured to a respective bolt 50 in FIG. 3. Each drawer also defines a plurality of rivets 46 and 56 that extend through the front panel of the drawer. These rivets assist in securing the locking mechanism to the interior or rear surface of the front drawer panel.

The cabinet 5 defines two upstanding front edge panels 44 and 62 that frame the opening into which the drawers 11 are positioned. Each of these edge panels defines a lip against which the locking bolts of the drawers will engage in order to lock the drawers in place.

Figure 2:
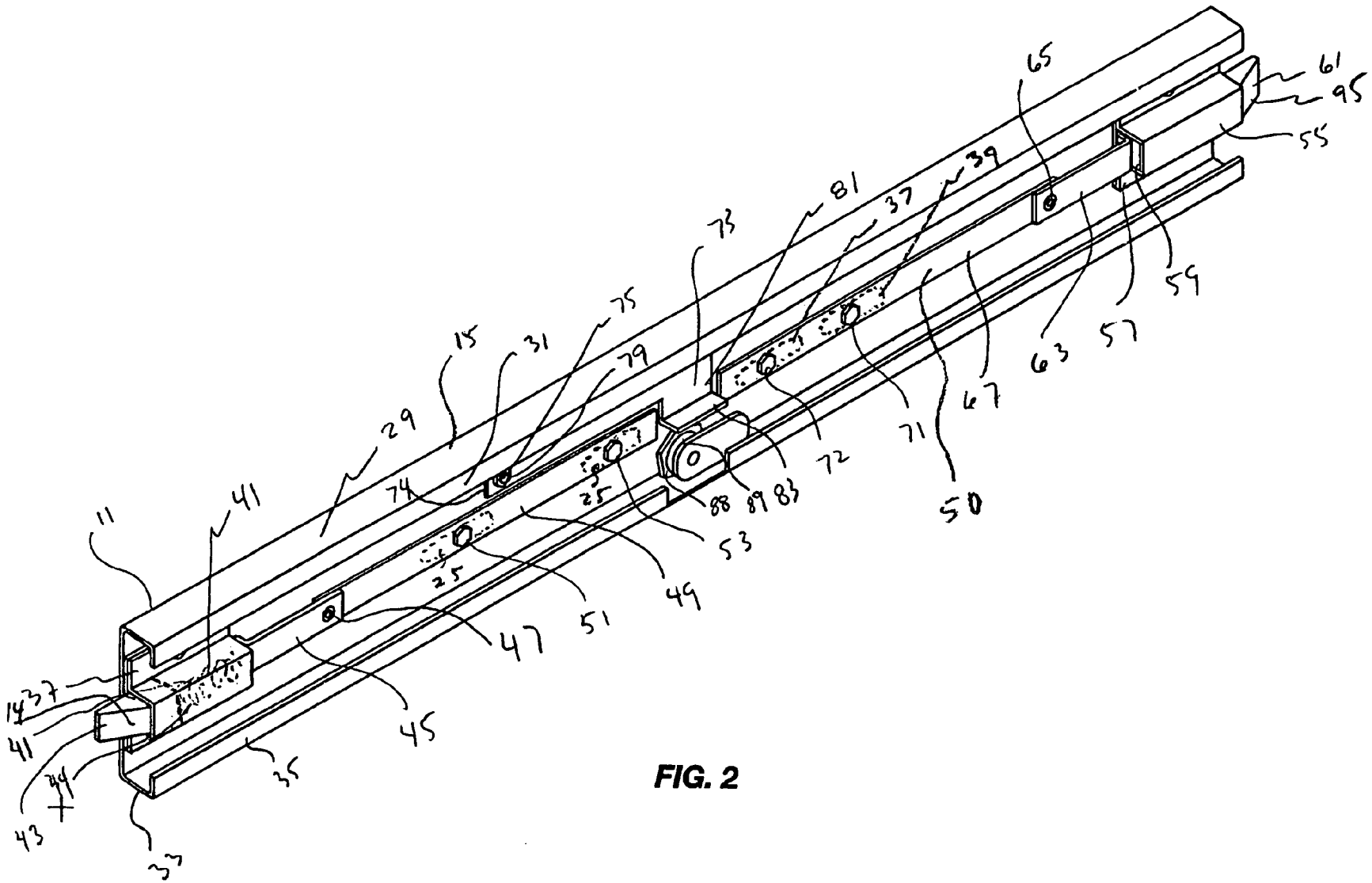
FIG. 2 is a perspective view of the interior face of a front wall of a drawer with a locking mechanism of the instant invention shown secured thereto.

FIG. 2 illustrates the actual locking mechanism of the invention. As shown, two laterally extending bolts 49 and 50 are displaceably secured to the rear face of the front drawer panel 15 of drawer 11. The first bolt 49 is retained in position by its interconnection to the handle 19 by means of two pins or bolts 51 and 53. These bolts 51 and 53 extend through respective apertures defined within bolt 49 and thereafter through a slot 25 defined within the panel 15. Thereafter, the pins 51 and 53 extend through the handle 19 and are secured thereto by threaded engagements into respective threaded openings defined within the handle 19. The bolt 49 includes an elongate member that is secured on a first end to a second elongate member 45 by rivet 47. Elongate member 45 is fitted on its free end to a securement head 43 that is slideably retained within a housing 44. The housing 44 defines a channel through its length that permits the element 45 to slide laterally back and forth through the channel. The housing 44 is secured to the rear face of the drawer front panel by a plurality of rivets 46 and 56 that extend through the front panel itself as shown in FIG. 1. The head 43 of the member 45 has an angulated planar surface. Positioned within the interior of the housing 44 is a biasing spring 41 that abuts against the housing and furthermore abuts against the element 45 to apply an outwardly directed force against the element 45 and, therefore, bias that element 45 into the extended position shown in FIG. 2. The housing 44 is shown as having a pair of flanges 37 that facilitate its securement to the rear face of the drawer front panel 15.

Second bolt 50 is constructed similarly to first bolt 49. Second bolt 50 includes a first section 67 that is secured to handle 21 by two bolts 71 and 72 that pass through respective slots 37 and 39 defined within the body of panel 15. Slots 37 and 39 are elongate slots with each slot having a longitudinal axis that is oriented horizontally, thereby permitting the lateral back and forth motion of the bolts 37 and 39 within those slots. The end of the second bolt 50 is secured to a secondary bolt 63 by a rivet 65 that passes through apertures defined in both the second bolt 50 and the secondary bolt 63. The secondary bolt 63 is fitted on its end with a securement head 61 that is slidably retained within a housing 55 similar to the securement head 43 and its associated housing 44. Likewise, the housing 55 is fitted with a biasing spring (not shown) that biases the securement head outwardly away from the housing 55. The free ends of the first and second bolts 49 and 50 that are positioned proximate the center of the front panel are positioned spacedly apart from one another. Positioned intermediate the two free ends of these bolts 49 and 50 is a pivotedly mounted latch 73 that is pivoted on its end 74 by a threaded pin 75 that has a head 77 positioned on the outward face of the panel 15. The pin extends through the front panel and thereafter through an aperture defined within the latch 73. A nut 79 is threaded onto the pin 75 to secure the latch in association with the pin 75. The latch is permitted to rotate both clockwise and counterclockwise about a pivot axle formed by the pin 75.

Figure 3:
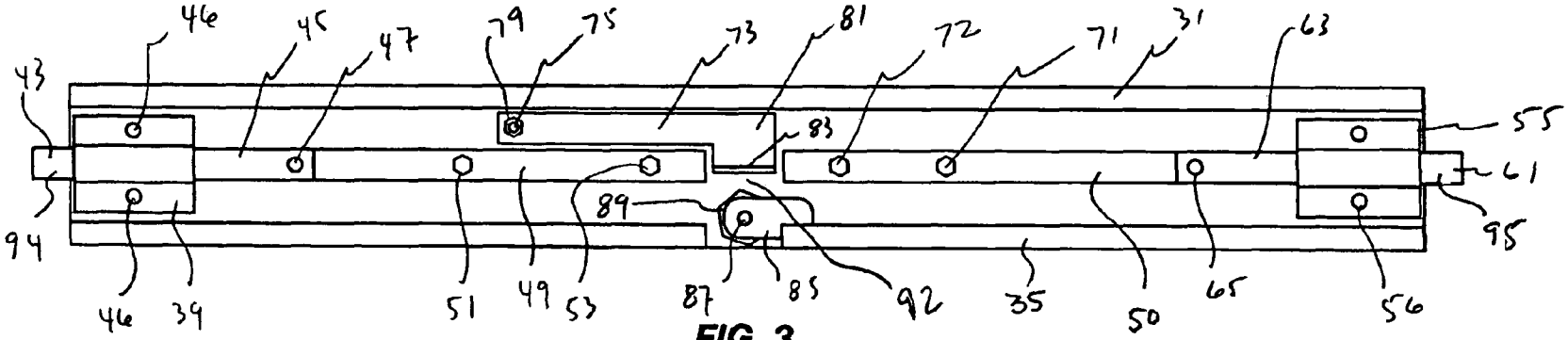
FIG. 3 is an elevational view of the locking mechanism of FIG. 2 shown in a locked condition.
Figure 4:
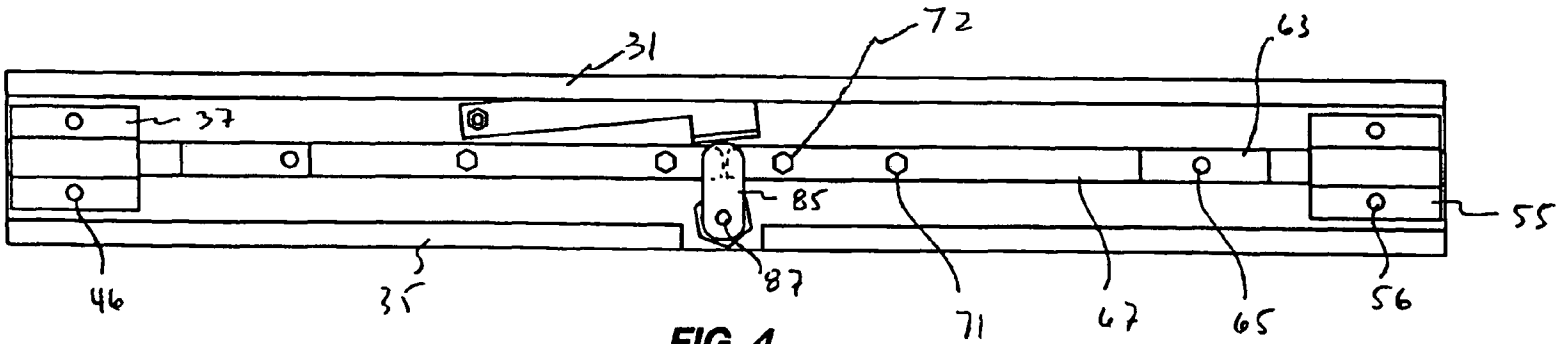
FIG. 4 is an elevational view of the locking mechanism of FIG. 2 shown in an open condition.

The opposing end of the latch 73 includes an "L"-shaped flange 81 that extends outwardly from the latch 73. The flange is dimensioned to be received within the space defined between the two ends of the bolts 49 and 50. When the flange 81 is positioned intermediate the two ends of the bolts as shown in FIG. 3, the two bolts are precluded from being displaced further toward the center of the panel 15. When the flange 81 is lifted upwardly out of the gap formed between the two ends of the bolts, as shown in FIG. 4, each of the ends of the two bolts may be displaced toward the center of the panel. In this latter configuration, the securement ends 43 and 61 are withdrawn from engaging the lips 44 and 62 of the cabinet, thereby permitting the drawer to be freely displaced outwardly from the cabinet. Whereas in the configuration shown in FIG. 3, the positioning of the securement heads 43 and 61 in an extended position, orients those heads behind the lips 44 and 62, thereby precluding the displacement of the drawer outwardly from the cabinet.

The outwardly extending leg 83 of the "L"-shaped portion of the flange 81 extends toward the interior of the drawer and out of the plane of the travel of the two bolts 49 and 50. A lever 85 is pivotedly secured in the drawer panel by a mounting assembly 88. The lever 85 pivots about a pivot axis 87 formed by a pin that passes through the lever 85 and which is interconnected to a conventional lock assembly 88. As shown in FIG. 1, lock assembly 88 may be a conventional key-type lock assembly that is secured in place by a locking nut 89. Notably, the path of rotation of the lever 85 is not within the plane of travel of the two bolts 49 and 50.

The lever 85 has a curved free end that is dimensioned to swing upwardly as shown in FIG. 4 and engage the leg 83 of the latch 73. The curved end of the lever permits the leg 83 to be pushed upwardly as the latch rotates about the pin 75. The lever is dimensioned to cause the flange 81 to be pushed out of engagement with the two ends of the bolts 49 and 50 by the rotation of the lever. When the flange 81 is removed from engagement with the bolt ends, the two bolt ends may be displaced toward the center of the panel as shown in FIG. 4, thereby leading to the retraction of the securement ends 43 and 61 within their respective housings 44 and 55.

In operation, when the drawer is in a closed condition as shown in FIG. 1, the securement heads 43 and 61 are in the orientation shown in FIG. 3. In this condition, the securement heads are positioned behind their respective lips 44 and 62, thereby retaining the drawer in a closed condition. Since the forward-most surface of each securement head, i.e., that surface that faces the front of the cabinet, is a planar surface, any attempt to pull the drawer outwardly with the securement heads in the position shown in FIG. 3 would result in that planar surface abutting against the interior surface of the lips 44 an 62, which in turn would resist such an outward movement. Furthermore, the positioning of the flange 81 of the latch 73 in the position shown in FIG. 3, i.e., intermediate the free ends of the bolts 49 and 50, would preclude the displacement of those bolts toward the center 92 of the drawer. As a result, the securement heads 43 and 61 would be held in a locking position.

In order to open the drawer, the user would first insert a key into the lock 88 and turn the key ninety degrees, causing the lever 85 on the interior face of the drawer to rotate into the position shown in FIG. 4. The rotation of the lever 85 would result in the engagement of the free end of the lever 85 to engage the leg 83 of the latch 73 and would cause that latch to rotate counterclockwise (as viewed from within the drawer) into the position shown in FIG. 3. Since the lever 85 is secured to rotate out of the path of travel of the two bolts 49 and 50, the lever 85 is free to rotate without engaging the bolts 49 and 50. As the lever engages the latch 73 and lifts the latch out of engagement with the two bolts 49 and 50, the two bolts may be displaced toward each other by the user moving the two handles 19 and 21 toward each other, i.e., the mounting bolts 51 and 53 are displaced along their receptive mounting slots while bolts 71 and 72 are likewise displaced along their respective mounting slots 37 and 39. Once the bolts 49 and 50 have been displaced sufficiently to cause the securement heads 43 and 61 to be out of engagement with the lips 44 and 62, e.g., into the orientation shown in FIG. 4, the drawer may be pulled outwardly from the cabinet. When the user releases the handles 19 and 21, the springs in the housings 44 and 55 urge the bolts 49 and 50 outwardly back into the orientation shown in FIG. 3. When the user pushes the drawer back into its closed condition, the angled planar surfaces 94 and 95 of the two securement heads 43 and 61 permit the bolts 49 and 50 to be displaced toward one another, i.e., toward center 92 sufficiently to permit the heads to clear the lips 44 and 61 and thereby permit the drawer to be pushed back into its closed condition.

It is to be understood that the descriptions of the various illustrated embodiments are merely illustrative of the various concepts of the invention. The essence of the invention is more disclosed in the claims that are appended hereto.

What is claimed is:

1. A locking mechanism for use with a drawer disposed within a cabinet, said locking mechanism comprising:

a first bolt displaceably secured to said drawer, said first bolt having a free end adapted for engaging with said cabinet in a locked condition;

a second bolt displaceably secured to said drawer, said second bolt having a second free end adapted for engaging with said cabinet in said locked condition a latch, pivotally secured to said drawer, said latch being positionable in abutment against said first bolt to retain said first bolt in said locked condition, said latch having an extension thereon disposed spacedly from a path of travel of said first bolt; and a displaceable lever disposed in said drawer, said displaceable lever being positioned to engage said extension and displace said extension out of engagement with said first bolt.

2. The locking mechanism of claim 1, further comprising a biasing mechanism attached to said first bolt for biasing said first bolt into said closed condition.

3. The locking mechanism of claim 1, wherein said path of travel of said first bolt and a path of travel of said second bolt have a common axis.

4. The locking mechanism of claim 3, wherein said paths of travel of said bolts are oriented 180 degrees from one another.

5. The locking mechanism of claim 1, wherein said latch is positionable intermediate said first bolt and said second bolt to effect said locked condition.

6. The locking mechanism of claim 5, wherein said lever is disposed spacedly from said travel path of said first bolt.

7. The locking mechanism of claim 5, wherein said lever is disposed spacedly from said travel path of said second bolt.

8. The locking mechanism of claim 6, wherein said lever is disposed spacedly from said travel path of said second bolt.

9. The locking mechanism of claim 8, wherein said paths of travel of said bolts are oriented 180 degrees from one another.

10. The locking mechanism of claim 9, wherein said extension extends outwardly from said latch perpendicularly in a direction perpendicular to said paths of travel of said bolts.

11. The locking mechanism of claim 9, wherein said lever further includes a connection structure accessible from an exterior surface of said drawer for actuating a movement of said lever from a location on said exterior surface of said drawer.

12. The locking mechanism of claim 10, further comprising a biasing mechanism attached to said first bolt for biasing said first bolt into said closed condition.

13. The locking mechanism of claim 11, further comprising a second biasing mechanism attached to a second bolt for biasing said second bolt into a closed condition.

14. The locking mechanism of claim 12, wherein said latch is disposed to fall into a position intermediate said two bolts under the force of gravity, thereby effecting a locked condition.

15. The locking mechanism of claim 13, wherein said lever is mounted for rotational movement.

16. The locking mechanism of claim 14, wherein said an axis of rotation of said lever is oriented perpendicular to said directions of travel of said bolts.

17. The locking mechanism of claim 15, wherein said drawer defines a ledge, said lever being disposed on said ledge.

* * * * *